United States Patent [19]

Crouch

[11] 4,285,153

[45] Aug. 25, 1981

[54] WEAPON

[76] Inventor: Alferd H. Crouch, 2502 Arizona Ave., #3, Santa Monica, Calif. 90404

[21] Appl. No.: 36,414

[22] Filed: May 7, 1979

[51] Int. Cl.[3] ..... F41C 19/12

[52] U.S. Cl. ..... 42/84; 102/472; 102/202.5

[58] Field of Search ..... 42/84; 89/28 R, 135; 102/46, 203

[56] References Cited

U.S. PATENT DOCUMENTS

| | | | |
|---|---|---|---|
| 2,099,993 | 11/1937 | Tauschek | 42/1 R |
| 3,427,924 | 2/1969 | Johnsen | 42/84 |
| 3,815,271 | 6/1974 | Lynn | 42/84 |
| 3,854,231 | 12/1974 | Broyles | 42/84 |

*Primary Examiner*—Charles T. Jordan

*Attorney, Agent, or Firm*—Roger A. Marrs

[57] ABSTRACT

A firearm or weapon is disclosed herein having a stock incorporating a plurality of elongated barrels for releasably holding a load or ammunition tube and a hand grip having a trigger mechanism operably coupled to an electronic firing circuit for igniting or detonating the ammunition held in the tube. A sequence control circuit is connected between the firing circuit and the trigger for sequentially and electronically detonating selected ones of a multiplicity of firing chambers within the ammunition tube enclosing powder, wadding and shot respectively. The ammunition is loaded serially in the elongated tube in an end-to-end relationship so that the loaded tube provides a unitary construction and wherein the firing circuit is embedded within the material thereof in fixed spatial relationship.

6 Claims, 7 Drawing Figures

TRIGGER SEQUENCE CONTROL

WEAPON

BACKGROUND OF THE INVENTION

1. Field of the Invention

This invention relates to firearms or weapons and more particularly to a novel weapon capable of firing a plurality of ammunition loads in a serial manner and to the serial ammunition loaded or carried in a tube insertably received in the barrel of the weapon.

2. Brief Description of the Prior Art

In the past, it has been the conventional practice to employ a weapon having a single or double barrel in which a single load of ammunition is introduced into a firing chamber and the load is mechanically detonated to fire the shot incorporated in the ammunition load. After firing, the chamber is cleared and a new ammunition load is introduced for firing as previously described. This procedure can be done in a single shot or manual manner or, such as in automatic weapons, the pace or loading and unloading procedure rapidly increased so that multiple rounds or shots can be fired in quick succession. However, it is to be understood that regardless of how fast the mechanism for loading and unloading may be, the sequence is first to load the firing chamber with the proper ammunition followed by firing of that ammunition and removal of the residue or shell which is then replaced by another shell or ammunition load preparatory to a second firing.

Difficulties and problems have been encountered when employing such prior art devices and procedures which stem largely from the fact that the ammunition is loaded sequentially into the chamber which is time consuming and the firing is achieved through mechanical means which is slow in reaction time and does not lend to multiple firing of ammunition loads.

Therefore, a long standing need has existed to provide a novel weapon which not only incorporates a multiplicity of ammunition loads which may be fired in a serial manner from a single firing chamber but one which may be electronically detonated so as to fire individual or multiple loads within the same firing chamber.

SUMMARY OF THE INVENTION

Accordingly, the above problems and difficulties are obviated by the present invention which provide a novel weapon having a stock for mounting a plurality of barrels and for incorporating a trigger mechanism and a firing circuit. And an ammunition tube is provided which houses a plurality of serially loaded ammunition units wherein each unit comprises a detonater, gun powder, wadding and suitable shot. The ammunition tube incorporates a firing circuit means which may be electronically energized for selectively detonating selected or respective ones of the plurality of ammunition loads.

An electronic sequence control is carried in the stock and operably connected between the trigger mechanism and the firing circuit so that the sequence of firing of the ammunition loads for units is automatic and does not require any pre-selection on the part of the operator. Means are provided on the inner bore of the ammunition tube for defining individual firing chambers therein and for accepting and distributing the forces of recoil into the barrel and stock of the weapon upon firing of the individual load or unit.

Therefore, it is among the primary objects of the present invention to provide a novel weapon which incorporates a plurality of ammunition loads that may be fired in a serial manner and in accordance with a pre-determined sequence from a single barrel.

Another object of the present invention is to provide a novel weapon having a single barrel for holding a novel ammunition tube containing a plurality of ammunition loads which may be detonated in a serial fashion.

Another object of the present invention is to provide a novel hand-held weapon which incorporates electronic firing circuits and sequential control networks for selectively detonating a multiplicity of ammunition loads in an orderly sequence.

Still a further object of the present invention is to provide a novel weapon having greater fire power than can be otherwise obtained by utilization of an ammunition tube carrying a plurality of loads and by incorporating an electronic firing means for sequentially detonating the ammunition loads.

Still a further object of the present invention is to provide a novel hand-held weapon incorporating an ammunition tube having a plurality of firing chambers in an end-to-end relationship for enclosing a load of powder, wadding a shot or missiles in each of the firing chambers and wherein each of the ammunition loads is separated by a detonating plate.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figures 1, 2, 3, 3A, 4, 5, 6:
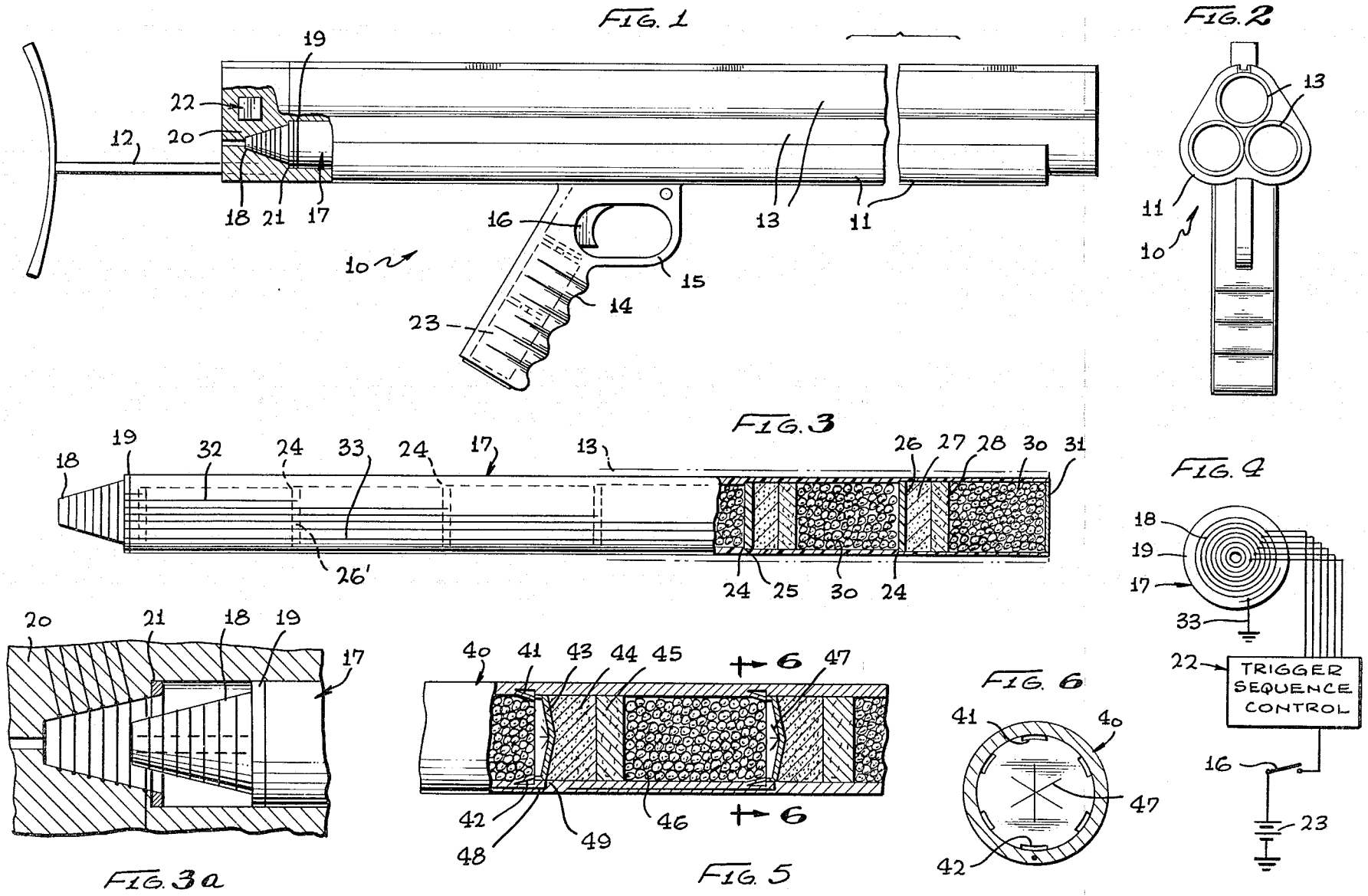
FIG. 1 is a side-elevational view, partly in section, of a novel firearm or weapon incorporating the present invention.
FIG. 2 is a front-elevational view of the firearm or weapon shown in FIG. 1.
FIG. 3 is a side-elevational view of a six-chambered cartridge or ammunition tube employed in the weapon of FIGS. 1 and 2 and partly broken away to expose a typical ammunition or firing load.
FIG. 3*a* is a fragmentary sectional view of the breech block showing circular electrical conductors on both the ammunition tube and the breech block receptacle preparatory to final loading.
FIG. 4 is a rear-elevational view with the ammunition tube or cartridge shown in FIG. 3 and diagrammatically illustrating a firing circuit therefore.
FIG. 5 is a cross sectional view of another embodiment of the present invention.
FIG. 6 is a transverse cross-sectional view of the ammunition tube or cartridge shown in FIG. 5 as taken in direction of arrows 6—6 thereof.

Referring to FIG. 1, the novel weapon of the present invention is illustrated in the general direction of arrow 10 which includes a stock 11 having a slideable shoulder piece 12 extending from one end thereof. The stock 11 mounts a plurality of barrels such as indicated by numeral 13. The barrels are arranged in fixed relationship with respect to each other as shown in FIG. 2 so that their open end is adjacent the end of the stock 11 opposite from its end carrying the shoulder rest 12. The stock 11 further includes a pistol grip 14 having a trigger housing 15 and a trigger 16. Barrel 13 is illustrated as having an ammunition tube 17 slideably illustrated therein so that its conical end represented by numeral 18 is received within a conical receiver forming a breech block illustrated in general by numeral 20. The conical end piece 18 includes an opening through which exhaust gases are expelled from the last charge in the tube 17 so that the tube will blow out or eject in convenient manner. For releasably holding the ammunition tube in place within the bore of the barrel 13, a magnet 21 is disposed in the breech block 20 about the conical end 18 of the tube which incorporates a metal piece 19 embedded therein to which the magnetic force of a magnet attracts for retention. An electronic circuit for controlling the sequence of firing is indicated by numeral 22 and the circuit is operably connected to a firing circuit, to be described later, carried on the ammunition tube and a source of power such as a battery 23 carried in the pistol grip 14. The trigger 16 operates a switch for connecting the positive power to the circuit 22.

Referring now to FIGS. 3 and 3*a*, the ammunition load or cartridge 17 is illustrated out of the barrel 13. However, a portion of the barrel 13 is illustrated in broken line to illustrate that the barrel is smooth-bored and that the outside diameter of the ammunition tube or cartridge 17 will insertably fit in a snug manner within the barrel bore. The tube 17 is preferably composed of a plastic material having an internal bore which is tapered or stepped to provide a plurality of firing chambers. In the present illustration, six chambers are defined and six ammunition loads are incorporated therein. Each firing chamber is opened at its end closest to the end of the barrel 13 from which the projectiles are intended to fly and the opposite end of each firing chamber is defined by an annular shoulder such as is indicated by the numeral 24 in connection with the outermost firing chamber and circular shoulder 25 associated with the next or second firing chamber in the tube. In this manner, the plurality of firing chambers are arranged in a serial succession in an end-to-end relationship and each firing chamber includes a separate ammunition load. Each load comprises a detonater plate 26, a powder charger 27, wadding 28 and a missile or projectile such as a load of shot 30. It is to be understood that although shot is illustrated, other missiles may be employed such as darts, flares, bullets or the like. The extreme end opening of the bore in tube 17 is closed by a closure member of blowout disc 31. In this manner, the shot 30 is captured between the blowout disc 31 and the wadding 28.

For detonating the charge in each of the firing chambers, an electronic firing circuit is employed comprising a plurality of conductors such as conductor 32. Inasmuch as six firing chambers are illustrated, it is to be understood that six conductors are employed which are preferably embedded within the material of the tube 17. At the terminating end of each of the conductors, a communication is made with the interior of the firing chamber at the detonating plate associated therewith. Therefore, it can be seen that conductor 32 terminates at the next to the last firing chamber with the detonating plate 26'. The opposite ends of the conductors terminate in circular conductors carried on the conical end 18, as shown in FIG. 3*a*. The circular conductors are arranged to register and index with corresponding circular conductors within the tapered or conical receiver of the breech block 20 so that an electrical contact is made with the sequence control 22. Preferably, the sequence control 22 is of the resistance type wherein a first pulse initiated by closing of a switch in response to actuation of trigger 16 causes the resistance of the conductors and associated resistors to be sensed so that the conductors will be energized in a serial fashion causing the outermost or first firing chamber to be detonated prior to the others. Upon a second depression of the trigger 16, the resistance of the conductors is sensed and the second firing chamber will be detonated. The other firing chambers will be sequenced in a similar fashion until the entire load of the ammunition tube has been fired.

As shown more clearly in FIG. 4, the trigger switch is indicated by numeral 16 and the resistance sensing is included within the sequence control block 22. The sequence control is very similar if not identical to the array of flash bulbs used on a flash bar in connection with flash photo taking with a conventional camera. The same circuit used in this connection may also be applied to the firing sequence of the firing chambers in tube 17. In addition to the six conductors which are positive in voltage carrying characteristics, a negative bus-bar or conductor is indicated by numeral 33 which serves as a common ground for all of the firing chambers. The bus strip 33 includes a connector at each of the detonating plates or discs in each of the firing chambers which cooperate with the positively charged conductor in that particular associated firing chamber for detonating the powder charge therein. In response to the depression of the switch 16 and in accordance with the resistance or ohmic value within the sequence control circuit 22.

It is to be understood that the ammunition load may take the form of pellets, shot, darts or flares. For example, flares may be loaded into the ammunition tube of one barrel while the other barrels are loaded with ammunition tubes carrying slugs, or shot. A barrel selector switch and enabling circuit may be carried on the stock for operator selection of a particular barrel to be fired. Also, the weapon 10 may be operated as fully automatic for one barrel of six shots followed operation and firing of another barrel as fully automatic after trigger release and subsequent pull. Safety switches may be incorporated as this aspect is important during reloading procedures.

Referring now in general to FIGS. 5 and 6, another embodiment of the invention is illustrated wherein the ammunition tube is represented by numeral 40 and the tube is characterized as having a smooth and constance diameter bore therein for holding the plurality of ammunition on charges. However, each firing chamber within the tube is defined by a plurality of at least six tabs, such as indicated by numerals 41 and 42 against which a cone-shaped detonater plate butts. The detonater plate is illustrated by numeral 43 and immediately ahead thereof is a powder charge 44 and wadding 45. The shot or missile is indicated by numeral 46. Preferably, the detonater plate 43 is scored at its central section as indicated by numeral 47 so that the plate will break apart and disintergrate upon ignition. The firing circuit is identical to that previously described and, by way of explanation, a conductor is illustrated by numeral 48 which terminates in contact with the detonater plate 43 at connector point 49. This conductor is preferably for carrying a positive voltage and the negative bus bar is connected on the opposite thereof so that a complete electrical circuit will result in producing a spark for ignition.

Therefore, it can be seen that the novel weapon of the present invention provides not only a new weapon for discharging a multiplicity of firing chambers in a predetermined sequence under electronic control but provides a new form of ammunition in the embodiment of ammunition tubes 17 and 40 respectively. In operation, a selected ammunition tube is merely inserted into the bore of the barrel 13 and the magnet 21 will attract the metal disc on conical end 18 so that the ammunition tube will seat properly in the tapered receptacle therefore. By proper seating, the circular conductors carried on the conical end 18 will index and register with the corresponding circular conductors carried on the breech block 20 which will connect the sequence control 22 to the firing circuit. Each ammunition tube is fully loaded and because of the sequence control 22, the outermost charge will be detonated first upon the first depression of the trigger. The firing chamber adjacent to the outermost firing chamber will be the second to detonate upon a second depression of the trigger 16. The sequence will follow for the multiplicity of firing chambers until the last chamber has been detonated in which case the expanding gases will forcibly dislodge the ammunition tube from its seat in the breech block 20.

With respect to the ammunition tubes 17, blowback is prevented by means of the detonater plates which engage with the annular shoulders 24 of each chamber. With respect to the tube 40, blowback is prevented due to the detonating conical discs engaging with the six tabs of the adjacent firing chamber.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A hand held weapon comprising the combination of:

a stock;

at least one barrel carried on said stock;

an ammunition load insertably carried in said barrel;

said ammunition load having a plurality of firing chambers, each holding a quantity of a powder charge, wadding and missile respectively;

a detonation plate separating each firing chamber from its adjacent firing chamber;

said ammunition load further includes recoil means adjacent each of said detonation plates for absorbing recoil shocks upon ignition of powder immediately ahead thereof;

electronic means cooperatively carried on said stock and said ammunition load for selectively firing or igniting each of said powder charges in each of the firing chambers;

said electronic means includes a plurality of conductors embedded in said ammunition load and in registry with a second plurality of conductors embedded in said stock;

a sequence control means coupled to said second plurality of conductors for selectively igniting said firing chamber powder charges;

a trigger mechanism and power source operably coupled together in series with said conductors to energize said sequence control means; and said recoil means includes a plurality of tabs extending into each of said firing chambers of said ammunition load to terminate immediately behind said detonation plate in an adjacent firing chamber.

2. The invention as defined in claim 1 wherein:

each of said firing chambers includes missiles selected from the following classes of shot, flares, darts, bullets or the like.

3. The invention as defined in claim 2 wherein:

said ammunition load is an elongated hollow tube having said recoil means slightly projecting into the bore thereof adjacent each of said detonation plates.

4. The invention as defined in claim 3 wherein:

magnetic means are operably carried on said stock adjacent said ammunition tube for releasably holding said tube in said barrel.

5. The invention as defined in claim 4 wherein:

said selected tube end is conical and said stock includes a tapered breech for insertably receiving said tube conical end.

6. The invention as defined in claim 5 wherein:

said first plurality of conductors include circular segments on said conical end and said second plurality include circular conductors in said tapered breech communicating with said first circular segments in registry therewith.

* * * * *